United States Patent [19]

Roberts et al.

[11] Patent Number: 4,771,558

[45] Date of Patent: Sep. 20, 1988

[54] MOTION BOARD DRIVE SYSTEM WITH SELF ALIGNMENT

[76] Inventors: William D. Roberts, Mill House, Glen Wyllin, Kirk Michael; Graham M. Stopford, The Nook, Bradda East, Port Erin, both of Isle of Man

[21] Appl. No.: 10,808

[22] Filed: Feb. 4, 1987

[30] Foreign Application Priority Data

Jan. 8, 1986 [GB] United Kingdom ..... 8618868

[51] Int. Cl.[4] ..... G09F 11/02

[52] U.S. Cl. ..... 40/505

[58] Field of Search ..... 40/503, 504, 505, 470, 40/493, 473; 474/150, 166

[56] References Cited

U.S. PATENT DOCUMENTS 2,149,551 3/1939 Robert ..... 40/505

2,978,821 4/1961 Kaufmann, Jr. ..... 40/505

3,313,165 4/1967 Evans ..... 40/473

4,189,859 2/1980 Ahlgren ..... 40/505

*Primary Examiner*—Gene Mancene

*Assistant Examiner*—Cary E. Stone

*Attorney, Agent, or Firm*—Head & Johnson

[57] ABSTRACT

A logic control linear drive magnetic motor is used to reciprocate approximately 180° flat panels which make a display board. Each panel of the display board is connected to a pulley which is in a plane perpendicular to the longitudinal dimension of the vane. A continuous drive cord is connected to each end of a shuttle cylinder of the motor and is wrapped around the pulley drum. The pulley drum is provided with self-alignment by providing slippage between a plate connected to the vane and the drum proper.

9 Claims, 5 Drawing Sheets

MOTION BOARD DRIVE SYSTEM WITH SELF ALIGNMENT

DISCLOSURE STATEMENT

A search revealed the following U.S. Pat. Nos.:

4,151,447
3,185,909
4,518,317
3,292,065
4,352,048
3,548,273
3,566,224
4,439,698
4,509,001
4,463,300
4,456,934
4,442,390
4,422,027
4,187,453
4,455,512
3,219,854
3,089,131

While none of these patents show applicant's claimed invention, attention is directed to U.S. Pat. Nos. 2,353,265 to Pullen and 2,603,897 issued to Wagner. The Pullen patent is an animated exhibitor and has strips which are interconnected by the individual panels 18 do not have pulleys on each end and further they do not have a cord which wraps around these pulleys and rotates the individual strip-like members $A_1$, $A_2$, $A_3$, $A_4$ and so forth. The Wagner patent does not have a cord looped around pulleys and connected to a linear motor to obtain reciprocation but rather it uses a shaft 39 to turn disk 38 to cause reciprocation of the rack 35.

RELATED APPLICATIONS

This application is related to U.S. patent application Ser. No. 893,939, filed Aug. 6, 1986 and entitled "MOTION BOARD DRIVE SYSTEM", William D. Roberts and Graham M. Stopford, inventors.

BACKGROUND OF THE INVENTION

This invention is related to an electromagnetic display system which alternately displays two different messages or illustrations displayed on opposite sides of flat vanes which make two display areas. It relates especially to a new system for aligning the vanes.

There is presently being developed a system for alternating advertising messages when Message One and Two are alternately displayed to one audience. It includes a frame which supports a first set of a plurality of vanes or strips which are pivotally suspended from the frame. The pivots define a line which is normally straight. When the vanes are rotated to alignment in one direction they form a surface upon which Display One is shown. On the reverse side of the vanes, there is a jumbled Display Two. When the vanes are each rotated 180°, Display Two, instead of Display One, is visible to the observer. A motor is mechanically connected to each of the vanes for alternately driving them in one direction and then the other.

It is an object of this invention to disclose a new system for properly aligning the vanes.

SUMMARY OF THE INVENTION

This is an improved vane alignment system for use with a device for alternately exhibiting Display One and Display Two of a display board which has a first frame and a set of plurality of vanes, each vane being supported at one end from said vane at a pivot. The vanes are rotatable so that in one position, the vanes form an essentially flat surface, a First Display area, and when rotated a selected amount, form a Secondary Display area. A linear motor is supported by the frame. Preferably a drive cord is looped about each of these pulleys and the length of the drive cord is adjusted so that these are quite taut. The reciprocating movement of the shuttle cylinder within the motor causes the drive cord to move which in turn causes the vane pulleys to rotate first in one direction and then in another. The vanes are connected in a novel manner to the pulley.

The pulley includes a drum about which the drive cord is looped. The vanes are connected through a spindle to a top plate. The frictional force between the top plate and the drum cause them to rotate together. When rotation of the top plate is impeded and the frictional force is exceeded slippage occurs between the drum and the top plate. This feature is utilized to cause automatic alignment of the vanes.

In an especially preferred embodiment, a means is provided to hold the drum against the plate such that a torque $T_p$ is required to turn said drum with respect to said plate. It is preferred that the motor torque $T_m$ be less than the number of pulleys times $T_p$. Then an individual clutch will slip if its vane is misaligned and then alignment will be obtained. A limiting bar supported by the frame will stop the rotation of misaligned vanes.

DETAILED DESCRIPTION OF THE PREFERRED EMBODIMENT

Figure 3:
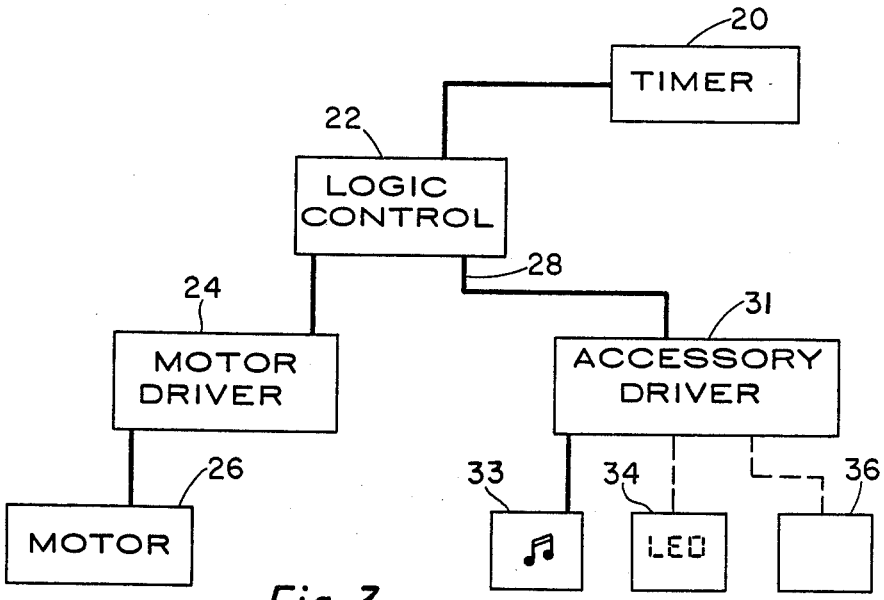
FIG. 3 is a block diagram showing the timer control and motor drive.
Figure 1:
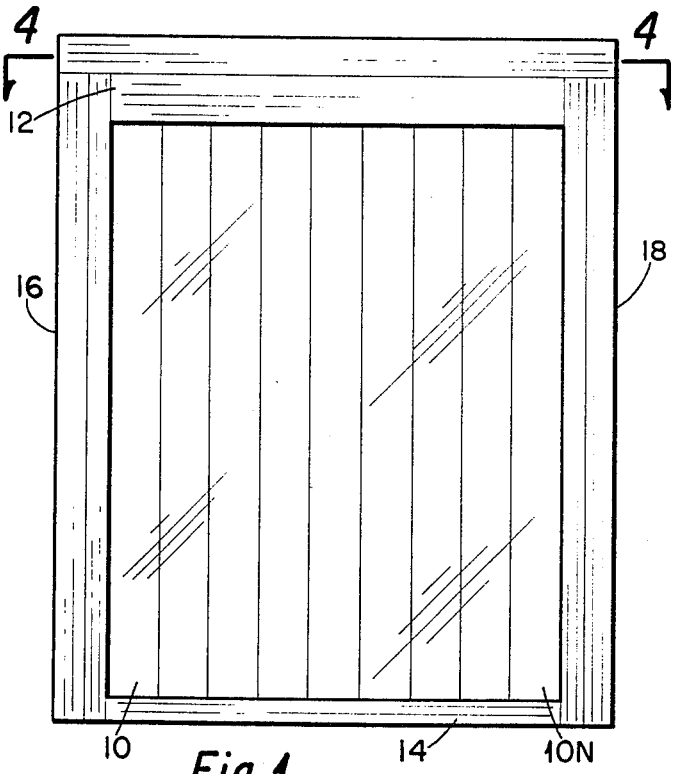
FIG. 1 illustrates a Motion Board Display having a plurality of vanes or panels.
Figure 2:
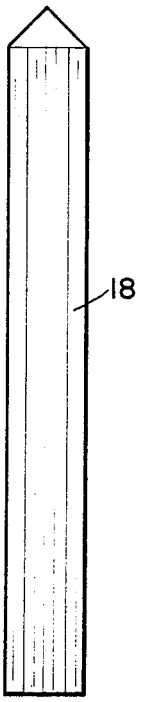
FIG. 2 is an end view of FIG. 1.

Attention is first directed to FIG. 1 which shows a Motion Board Display System which has a plurality of vanes or panels 10, a top frame 12, a bottom frame 14 and side frames 16 and 18. The vanes 10 form a large display within the frames. A portion of the display is on each elongated vane 10 through 10N. The reverse sides of vanes 10 to 10N comprise a second display area upon which a second display can be provided. Thus, by rotating the vanes 10 to 10N by approximately 180° the display can be changed from Display One to Display Two. We will now turn to FIG. 3 which shows a block diagram showing how the vane's rotations are controlled. Shown in FIG. 3, is a timer 20 which is connected to a logic control 22 whose output is connected to the input of motor driver 24 which may include a power amplifier to increase the power from the logic control to drive the motor 26. In some cases a power amplifier may not be needed. Timer 20 can be any suitable clocking timer which can be adjusted to have an output signal with the desired time occurrence. The signal from the timer 20 is fed to a logic control circuit 22 which is any convenient logic control circuit which upon receiving the selected output pulse from the timer 20 is programmed to activate motor driver 24 which can provide an electric current to motor 26 designated times and for duration as dictated by the logic control circuit 22. Logic control circuits are well known and it is not considered necessary to go into detail on this item. The logic control circuit can also have a second output 28 which is connected to an accessory drive 31 which upon receiving a selected control signal on conduit 28 can actuate the proper accessory. For example, a first control signal is used to actuate music from means 33 while a second signal could be used to control light circuit 34 and a third control signal could be used to control any desired accessory 36. The motor 26 and accessories may be driven by separate power supplies.

Figure 4:
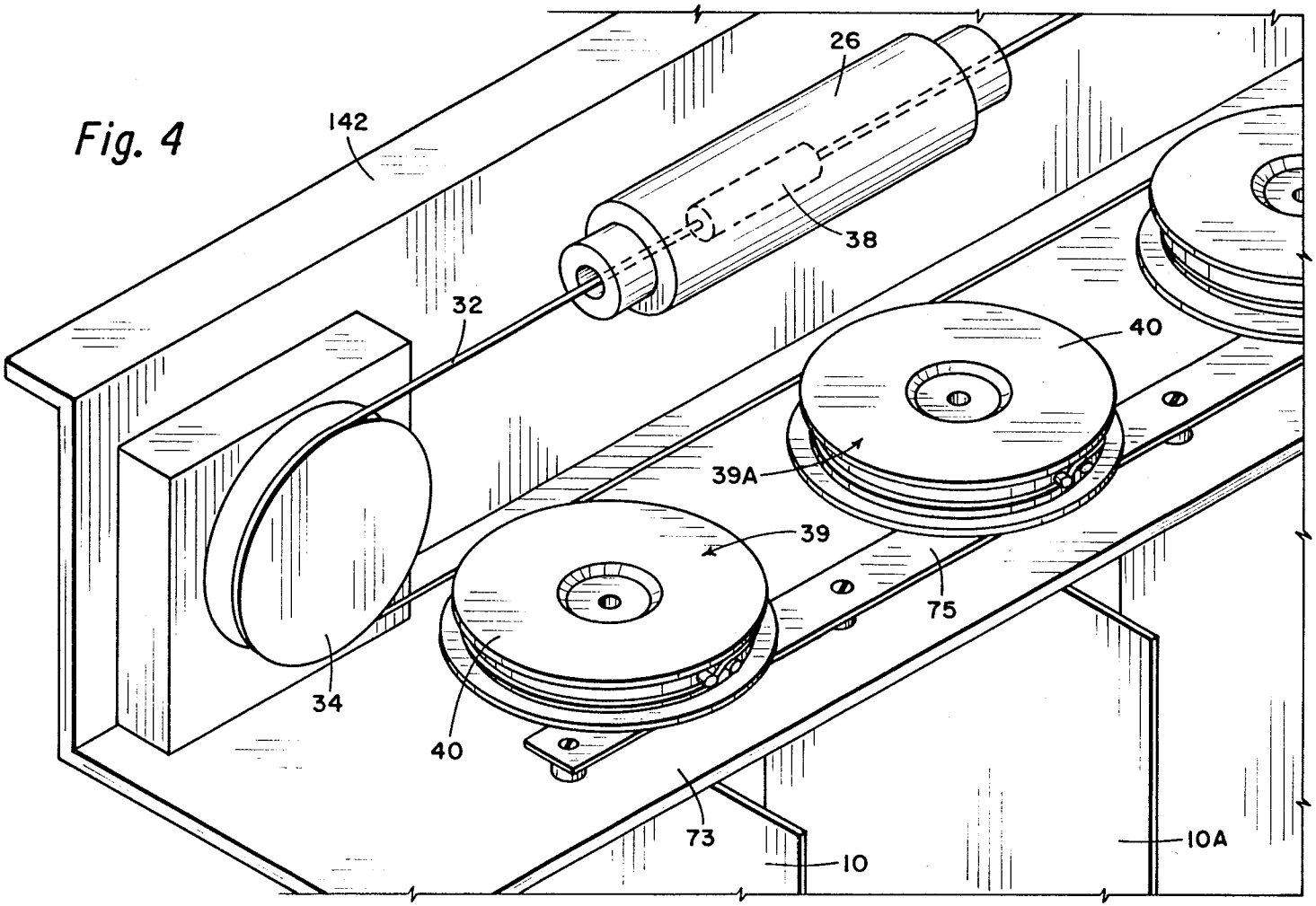
FIG. 4 is an enlarged view showing the drive motor and a part of the drive cord system.

Attention is next directed to FIG. 4 which shows a part of a drive system. Shown thereon is a drive cord 32 connected to a linear motor 26 having a shuttle drive 38. The motor 26 is supported from a frame 142. The cord 32 is wound, or looped, around pulley means 39 and 39A which are connected respectively to vanes 10 and 10A. As shuttle 38 moves alternately in different directions it causes the cord 32 to rotate pulleys 39 and 39A alternately in opposite directions approximately 180°.

Figure 5:
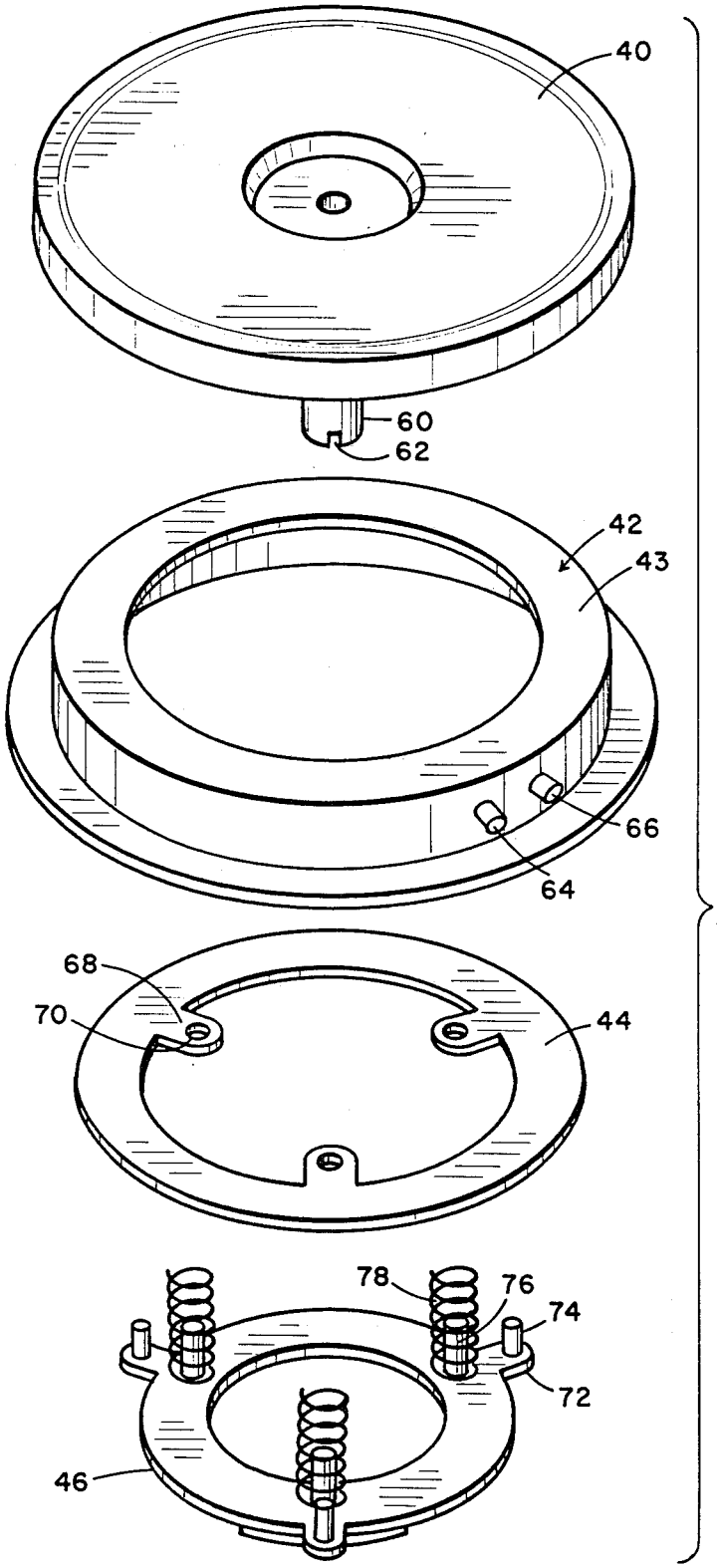
FIG. 5 is an exploded view showing the principal parts of the clutch assembly of this invention.

Attention is next directed to FIG. 5 which shows pulley 39 of FIG. 4 in an exploded view. Shown thereon is a top plate 40, a drum 42, a pressure plate 44 and a locking ring 46. The top plate has a spindle 60 with a groove 62. Drum 42 has two pins 64 and 66 about which the drive cord 32 is looped. When assembled, the annular surface 43 of drum 42 is in frictional contact with the underside of top plate 40. Pressure plate 44 has three ears 68 with each having a hole 70 therein. Locking ring 46 has three outwardly extending ears 72, and each ear 72 has a pin 74 for limiting the travel of the pressure plate with respect to the locking ring when assembled, and a locking pin 76 which has a pressure fit in the clutch aligning holes 70 of the pressure plate 44. A spring 78 is provided about each locking pin 76 and applies a biasing force through pressure plate 44 to force drum 42 against top plate 40. Although there has been shown three ears 72 with associated pins 74, 76 and spring 78, there could be any desired number. The number of ears 72 and associated parts would have to align with the ear 68 of the pressure plate 44, so they would have to have the same number.

Figure 7:
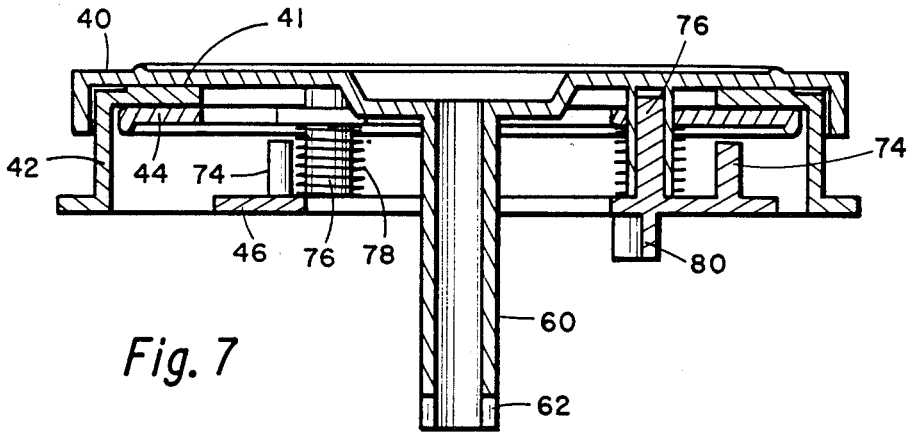
FIG. 7 is a view taken along the line 7—7 of FIG. 6.
Figure 6:
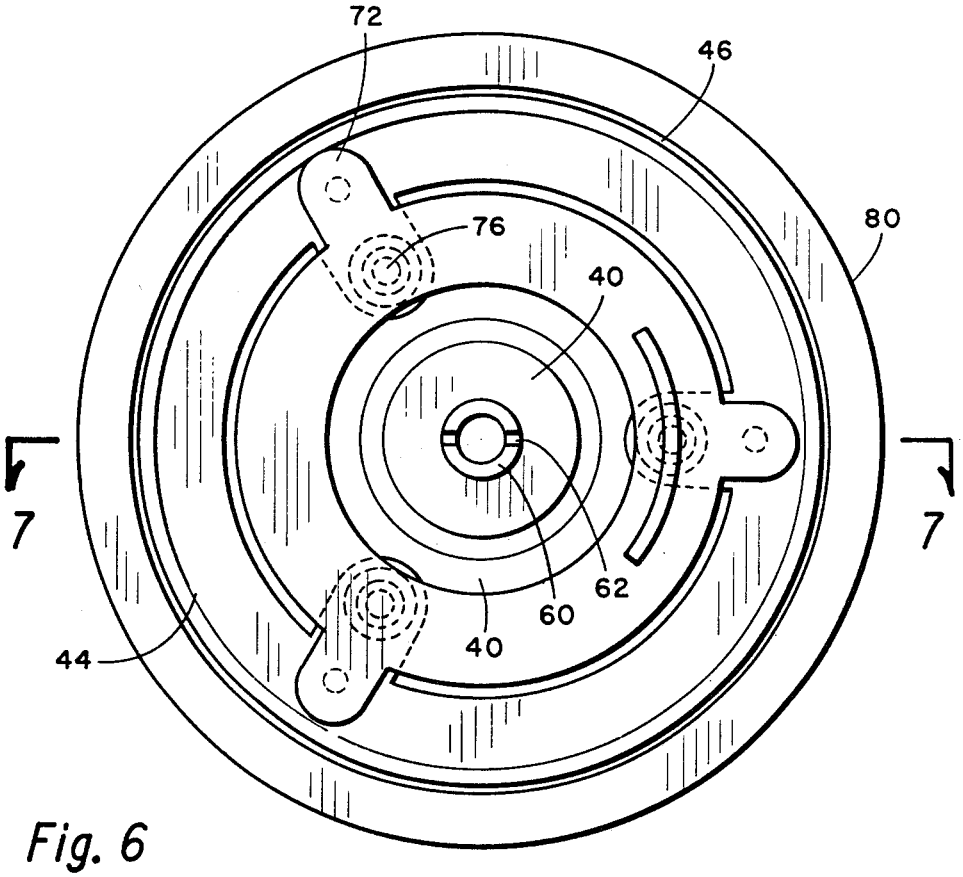
FIG. 6 is a bottom view of an assembled clutch and drum assembly of FIG. 5.

Attention is next directed to FIG. 6 which shows a bottom view and to FIG. 7 which shows a view taken along the line 7—7 of FIG. 6. As can be seen, the top plate 40 is provided with a spindle 60 which extends through or beneath the locking ring 46. Spindle 60 has a notch or groove 62. Drum 42 is held in frictional engagement with top plate 40 along an annular area 41. The locking ring 46 is provided with an arcuate end stop 80. This can be seen in FIG. 6. When assembled the groove 62 is aligned with the center point of end stop 80. The purpose of this will become apparent hereinafter. The pressure plate 44 holds the drum 42 against the top plate 40 with a force so that it takes the torque $T_p$ to move the drum with respect to the top plate 40. By carefully selecting the materials to the top plate and drum especially where they contact and the force of holding them together, one can obtain the desired force needed to acquire slippage between the top plate 40 and the drum 42.

Figure 9:
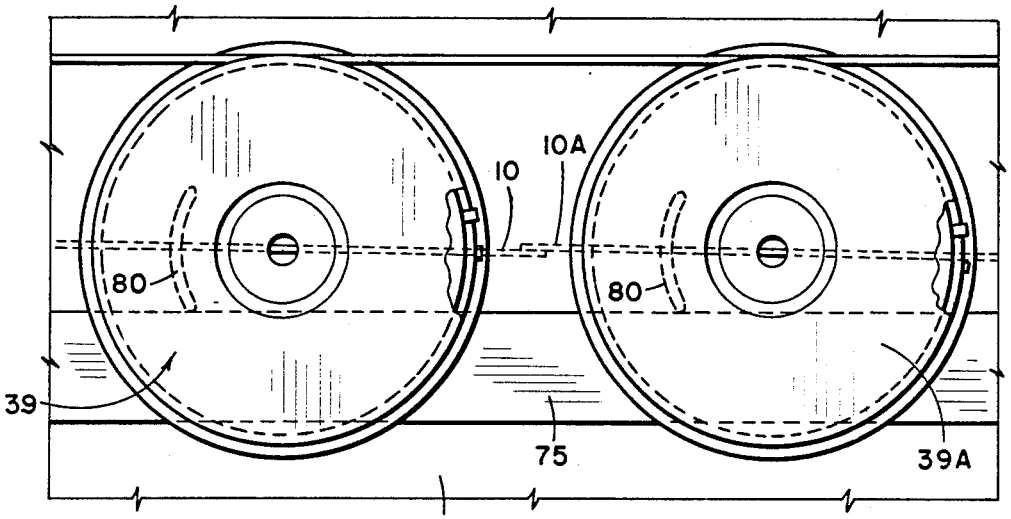
FIG. 9 is similar to FIG. 8 except the vanes have been rotated approximately 180°.
Figure 8:
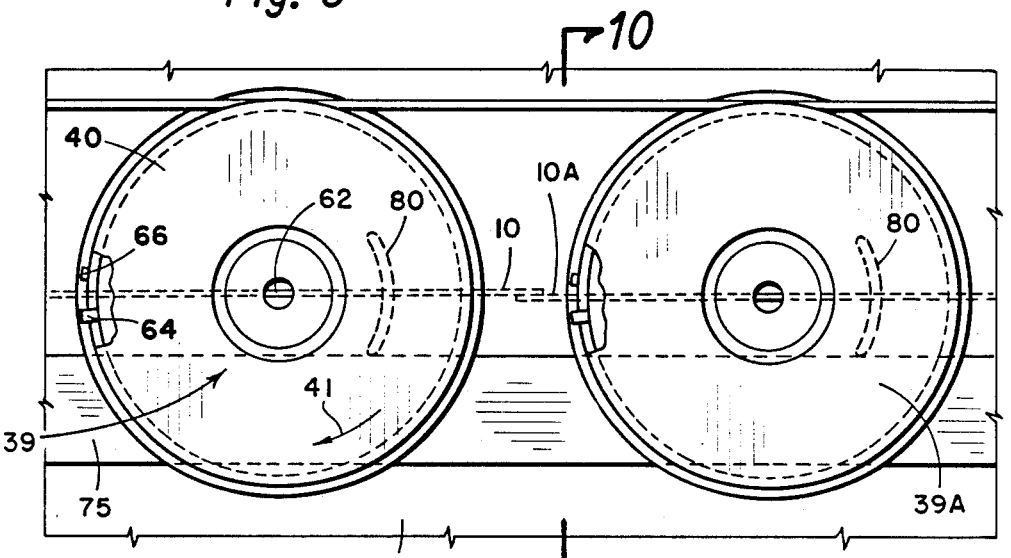
FIG. 8 is a top view of two adjacent pulleys.
Figure 10:
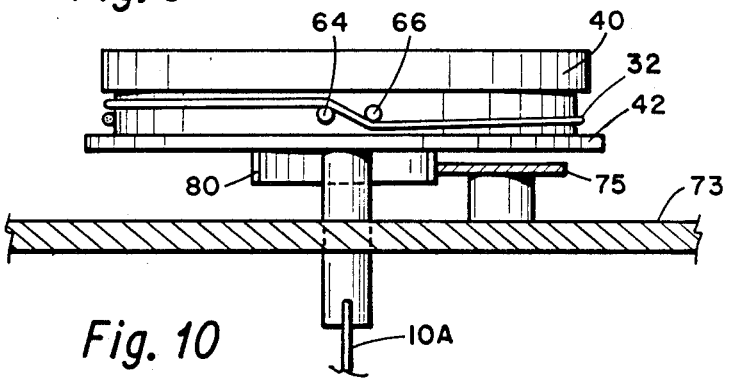
FIG. 10 is a veiw taken along the line 10—10 of FIG. 8.

Attention is next directed to FIG. 8 which shows pulley systems 39 and 39A which rotate respectively vanes or panels 10 and 10A indicated by the dashed lines. It is seen that there is a slight overlap between the two. Pulley system 39 cannot go any farther in the clockwise direction indicated by arrow 41 because stop 80 has contacted limiting bar 75 which is seen more clearly in FIG. 10 as being supported from frame 73. In FIG. 9 it is seen that the pulley systems 39 and 39A have rotated counterclockwise approximately 180°. There the stop 80 has contacted bar 75 and the rotation of the vane 30 has been stopped.

A brief discussion will now be had on the self alignment of the vanes. The vanes 30 are clipped to spindle 60 through groove 62 in a manner such that the vanes are aligned with the groove 62 as shown in FIGS. 8 and 9. As shown in FIGS. 8 and 9, the groove 62 is aligned with the center point between the ends of stop 80. The length of arcuate section 80 is such that one of its ends contacts limiting bar 75 when in the aligned positions shown in FIGS. 8 and 9. However, if the vane is out of alignment due to the improper positioning of top plate 40 with respect to drum 42 and the end of arcuate top 80 contacts limiting bar 75 before the drum 42 reverses its position, then there will be slippage between the drum 42 and the top plate 40 so that proper alignment is rapidly obtained. The torque of the driving motor must be sufficient to overcome the torque between top plate 40 and drum 42 so that the drum can continue to rotate although the top plate and its vane have been stopped by stop 80 contacting bar 75. Thus, if one of the vanes 30 is out of alignment when it is hooked to its pulley, cord 32 attached to drum 42, then there will be slippage between top plate 40 and drum 42 to cause the vane to come back in alignment so that the cord 32 has moved the vanes in one direction its maximum before it starts back in the other direction. If a vane is a lot out of alignment it may take more than one cycle to obtain complete alignment. In a preferred system, we make the motor torque to be less than $(n)T_p$ where n is the number of vanes and $T_p$ is the torque required in one pulley to rotate top plate 40 with respect to drum 42. Then individual clutches (top plate 40 and drum 42) will slip if their respective vanes are not aligned. However, once the vanes are aligned then the motor will stall when all the vanes touch each other in the position shown in FIGS. 8 and 9. This shows that there is perfect alignment. In this case, the clutch wear will be minimized. This will greatly increase the life of the device. It is preferred that the motor torque be greater than(n-1) time $T_p$, but less than $(n)T_p$.

It is seen with this system that when we place the vanes 10 on the spindle 60 that we do not have to have the position between the top plate 40 and the drum 42 exact. The reason is that we have this self aligning feature built into the pulley assembly and after one, or at most a few, reciprocations of the motor the vanes 30 and 30a will all be properly aligned to give the proper display area.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A device for alternately exhibiting display one and display two of a display board which has a frame, a set of a plurality of vanes, each vane having an upper end and being supported at one end from said frame at a pivot and rotatable so that in one position the vanes form an essentially flat surface as a first display area and when rotated by a linear motor a selected amount form a second diplay area, the improvement characterized by:

a pulley supported by said frame at the upper end of each of said vanes, each said pulley including;
a top plate;
a drum in frictional engagement with the top plate;
means to attached said plate to a vane;
means to drive said drum by said motor.

2. A device as defined in claim 1 including means to force said drum against said plate with the force such that a torque $T_p$ is required to turn said drum with respect to said plate.

3. A device as defined in claim 2 including a drive cord whose two ends are connected to said linear motor forming a loop, said drive cord being wrapped around each said drum of each said pulley such that movement of said drive cord rotates each said vane through rotation of said drum.

4. A device as defined in claim 3 in which the maximum force exertable by said linear motion on said drive cord is less than the summation of $T_p$ for all the pulleys.

5. A device as defined in claim 1 in which said plate includes a spindle with a groove in the end thereon for attaching to the upper end of said vane and also including a pressure plate and resilient means for forcing said drum against said top plate.

6. A device as defined in claim 5 including a locking ring and an end stop on said locking ring and being arcuate in shape with the center of such end stop being aligned with the direction of the groove in said spindle.

7. A device as defined in claim 6 including a stopping bar supported from said frame and positioned to be contacted by one end of each said stop at the end of each rotational movement of said locking ring when all the vanes are aligned.

8. A device as defined in claim 1 including two exterior pins on the exterior of said drum surface.

9. A device for alternately exhibiting display 1 and display 2 of a display board which comprises:

a frame;
a plurality of vanes, each vane being pivotally supported at one end from said frame and rotatable so that in one position the vanes form an essentially flat surface as a first display area and when rotated by a selected amount form a second display area;
a motor supported by said frame;
a pulley mounted on one end of each of said vanes;
each said pulley including:
a top plate;
a drum in frictional engagement with the top plate means to attached said plate to vane;
a drive cord having two ends each of which is connected to said motor forming a loop, said motor means being of a character to pull one end of said drive cord in one direction and the other end in an opposite direction, said drive cord being wrapped around the drum of each said pulley such that movement of said drive cord rotates each said vane through rotation of said pulley.

* * * * *